US005570793A

United States Patent [19]

Killough

[11] Patent Number: 5,570,793

[45] Date of Patent: Nov. 5, 1996

[54] FINGERNAIL COLOR DISPLAY

[76] Inventor: Beverly A. Killough, 709 Juniper La., Lewisville, Tex. 75067

[21] Appl. No.: 393,847

[22] Filed: Feb. 24, 1995

[51] Int. Cl.[6] ..... A47F 7/00

[52] U.S. Cl. ..... 211/70; 211/10; 211/163; 132/73; 434/100

[58] Field of Search ..... 211/163, 70, 10; 132/73; 434/100

[56] References Cited

U.S. PATENT DOCUMENTS

| | | | |
|---|---|---|---|
| 2,017,538 | 10/1935 | Kapavin | 434/100 |
| 2,020,100 | 11/1935 | Boyd | 434/100 |
| 2,300,170 | 10/1942 | Pickard | 434/100 |
| 2,417,677 | 3/1947 | Cohan | 434/100 |
| 3,070,906 | 1/1963 | Tinsley | 434/100 |
| 3,485,344 | 12/1969 | Aylott | 132/73 X |
| 4,099,627 | 7/1978 | Strada | 211/163 |
| 4,549,664 | 10/1985 | Gowan et al. | 211/163 X |
| 4,561,850 | 12/1985 | Fabbri et al. | 434/100 X |

*Primary Examiner*—Robert W. Gibson, Jr.
*Attorney, Agent, or Firm*—Jerry C. Ray

[57] ABSTRACT

A fingernail color display device has two or more platforms attached to a shaft which is rotatably mounted on a base. Apertures around the perimeter of each platform receive and hold for display colored artificial fingernails, so that the platforms may be rotated for viewing a variety of colors and a customer's finger may be placed under a nail for comparison with skin color, etc.

3 Claims, 3 Drawing Sheets

FINGERNAIL COLOR DISPLAY

CROSS REFERENCE TO RELATED APPLICATIONS

None.

BACKGROUND OF THE INVENTION

1. Field of the Invention

This invention relates to devices for displaying choices of fingernail colors and styles for artificial fingernails, and particularly to such devices which hold artificial fingernails on rotating platforms for viewing.

2. Description of the Related Art

Several stands or devices to display fingernail colors have been patented. These include several patents by Aylott, listed below, which include: a display ('344 patent) on which artificial nails are held by adhesive; a fingernail package ('614 patent) having a transparent window for viewing nails in the package; and another package ('139 patent) with a framed for holding fingernails for viewing. MacMahon discloses a tray with recesses for holding artificial nails, and Bensel discloses elongate strips of material with fingernail color on one end. The Thomas patent is for a cylinder with an open interior having a series of steps on which nails are displayed, but the nails are oriented toward the center of the opening.

The problem remaining to be solved, therefore, is how to display a large number of fingernail colors and styles which can be readily changed or updated, while allowing the customer to place her fingers under the displayed nails for viewing, or to remove individual nails from the display for viewing.

A pre-examination search by Applicant revealed the following United States Patents, here listed for the convenience of the Examiner:

| U.S. Pat. No. | Date Issued | Patentee |
|---|---|---|
| 1,990,630 | Feb. 12, 1935 | Bensel |
| 3,297,150 | Jan 10, 1967 | MacMahon et al. |
| 3,485,344 | Dec. 23, 1969 | Aylott |
| 4,106,614 | Aug. 15, 1978 | Aylott |
| 4,140,139 | Feb. 20, 1979 | Aylott |
| 4,968,253 | Nov. 6, 1990 | Thomas |

SUMMARY OF THE INVENTION

Progressive Contribution to the Art

Because the color of fingernail polishes in the bottle can vary considerably when applied to a fingernail, a display of artificial nails on which available colors are applied is useful. Patrons of beauty salons and nail boutiques may then choose their nail color with more confidence.

The present invention provides a convenient way for many nail colors to be viewed in rapid succession, and allows individual nails, with color applied, to be removed for comparison to skin color, etc. In addition, the nails on the display may be easily replaced as new colors become available.

A key feature of the invention is that the nails are displayed on the perimeter of rotating platforms, so the customer may turn the display to view a large number of color choices. The nails are arranged to extend outward from the platform so that a customer may place one of her fingers under a nail for a quick color choice.

OBJECTS OF THIS INVENTION

An object of this invention is to provide a device for holding artificial fingernails to display a variety of styles and color choices.

Another object is to provide such a device to hold colored artificial fingernail blanks and allow the blanks to be easily removed and inserted.

Still another object is to provide such a device that rotates on a base, so that a number of fingernail color choices may be quickly and easily viewed.

Yet another object is to provide a display which allows a finger to be placed under a colored display nail for comparison with skin color, etc.

Further objects are to achieve the above with a device that is sturdy, compact, durable, lightweight, simple, safe, efficient, and reliable, yet inexpensive and easy to manufacture, and operate.

The specific nature of the invention, as well as other objects, uses, and advantages thereof, will clearly appear from the following description and from the accompanying drawings, the different views of which are not necessarily scale drawings.

CATALOG OF THE ELEMENTS

Figure 1:
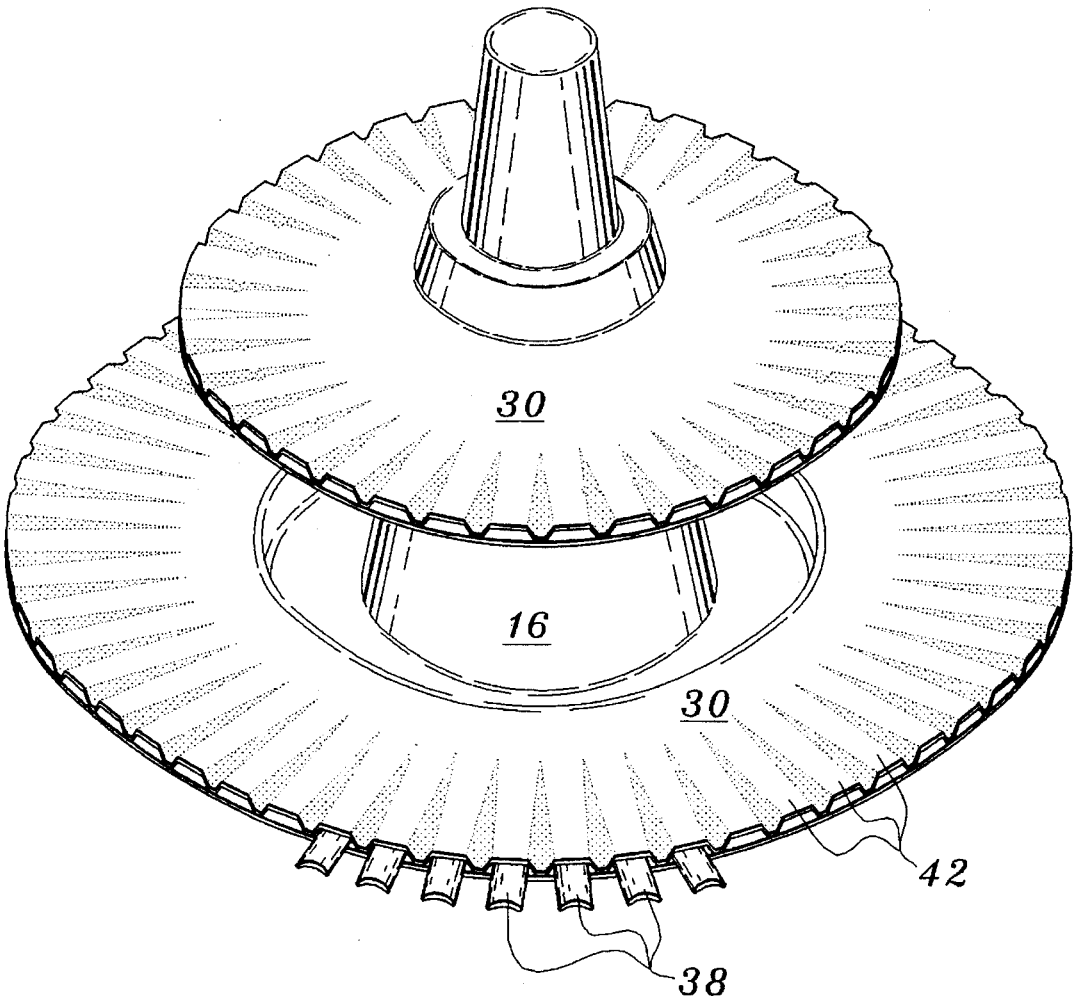
FIG. 1 is a perspective of the fingernail holder, with two platforms.

For convenience in correlating the reference numerals with the elements of the exemplary drawings, the following list of elements is provided:

10 Base
12 Bearing
14 Track
16 Central shaft
18 Central shaft lower section
20 Central shaft upper section
30 Platform
32 Platform lower part
34 Platform upper part
36 Apertures
38 Fingernail blanks
42 Writing surface

DESCRIPTION OF THE PREFERRED EMBODIMENTS

Figure 2:
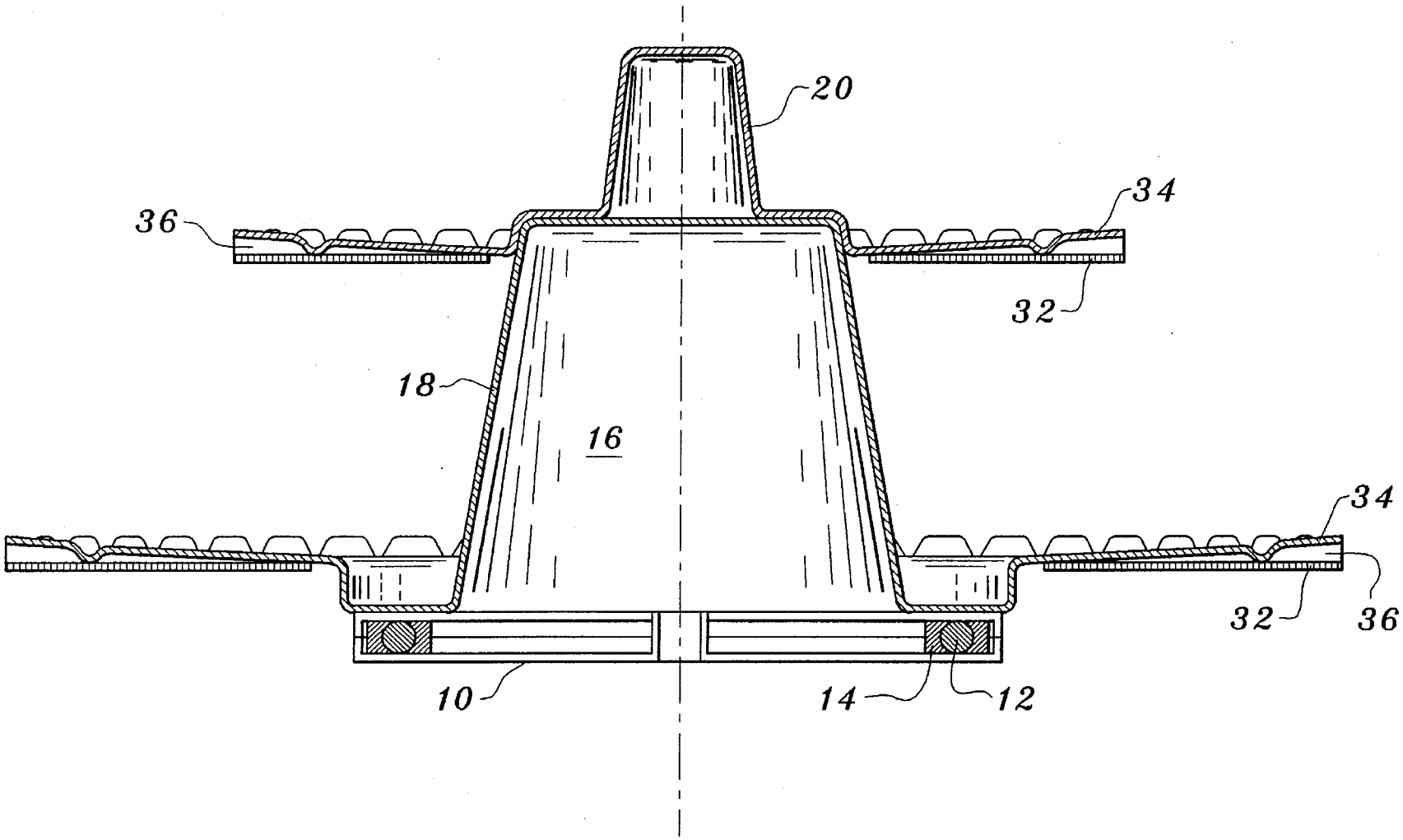
FIG. 2 is a vertical cross-section of the fingernail holder.
Figure 4:
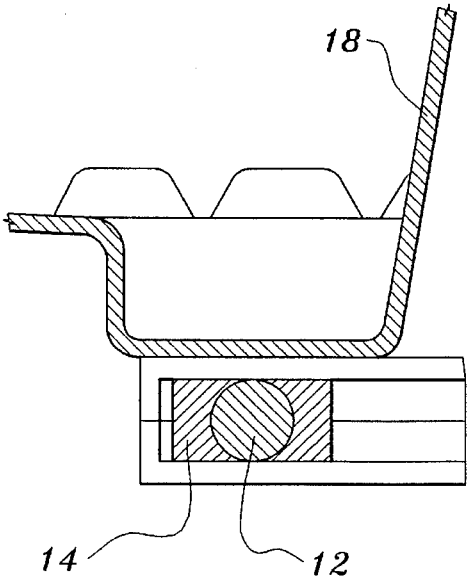
FIG. 4 is a detail of a vertical cross-section showing the base with its bearings.

Referring to FIG. 1, the invention comprises one or more concentric, rotating platforms 30 for holding artificial fingernail blanks 38 in apertures 36 around the perimeter of each platform. Referring to FIG. 2, a base 10 having sufficient width for stability supports the structure. As shown in FIG. 2 and FIG. 4, bearings 12 separate the moveable upper portion of the base 10 from the lower portion. Riding in a circular groove or track 14 in the lower portion of the base 10, the bearings support the upper part of the base and allow the upper base, together with the platforms, to rotate relative to the lower part. The base may be made from molded plastic, as is the remainder of the fingernail display device, or in the alternative from metal. In the embodiment shown, all the parts are made from plastic, and are joined together with adhesive. Referring again to FIG. 2, a vertical central shaft 16 attached to the upper part of the base supports one or more platforms. The platforms 30 are substantially horizontal, and are concentric with each other and with the central shaft 16. Around the perimeter of each platform 30 are a series of slot-like apertures 36, described below, into which artificial fingernail blanks are inserted for display.

Figure 3:
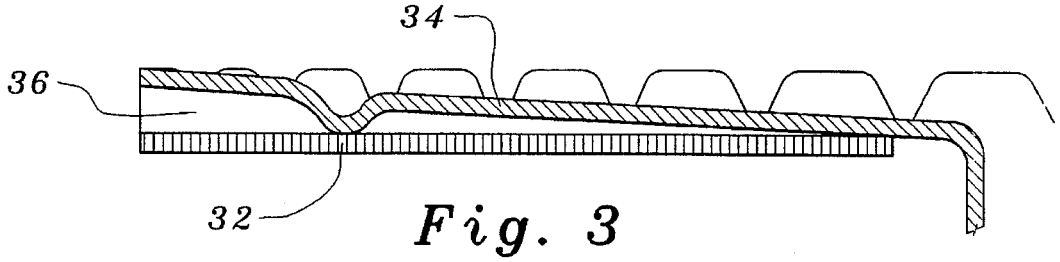
FIG. 3 is a detail of a vertical cross-section of the perimeter of one platform, showing a fingernail slot.

Referring to FIG. 3, each platform is formed by two pieces of equal diameter, adhesively or otherwise secured together; the configuration of the perimeter of each piece forms the slots or apertures 36 which receive the fingernail blanks. The lower platform portion 32 is essentially planar; in one embodiment this planar piece is circular with a circular opening in its center, and forms the lower part of the platform. The upper part 34 of the platform has a fluted edge, shown in FIG. 1. When the two pieces are placed together and secured with adhesive or by some other means, the planar lower piece bridges each flute, closing the flute except for an aperture 36 which opens outwardly toward the perimeter of the platform 30. As shown in FIG. 2 and FIG. 3, an annular indentation in the upper piece of the platform is in contact with the lower piece of the platform; the indentation forms an inner wall of each aperture, and also strengthens the platform assembly. Each aperture 36 has the cross-sectional shape of the base of a truncated triangle, and has dimensions so that a fingernail blank 38 inserted into the aperture 36 fits closely. Held in place by friction, the blanks may be removed for examination and then reinserted into the display.

Referring again to FIG. 1, an area with a surface 42 suitable for writing is provided above each fingernail slot; the name of the fingernail color displayed in that particular slot is written on the writing surface 42 above the slot.

In one embodiment, shown in FIG. 2, the shaft 16 which supports the platforms is formed in sections. A single piece of injection-molded plastic comprises a section of the! central shaft and the fluted upper portion 34 of one platform, which flares out like a skirt from the lowermost shaft. That is, the central part of the platform is extended axially to form a section of the central shaft. Each section of the central shaft has the shape of a frustum of a cone. The truncated top of the lower shaft section 18 forms an attachment surface for the upper section 20 of the shaft. Similar to the lower section, the upper shaft section flares out to form a part of the upper platform.

Figure 5:
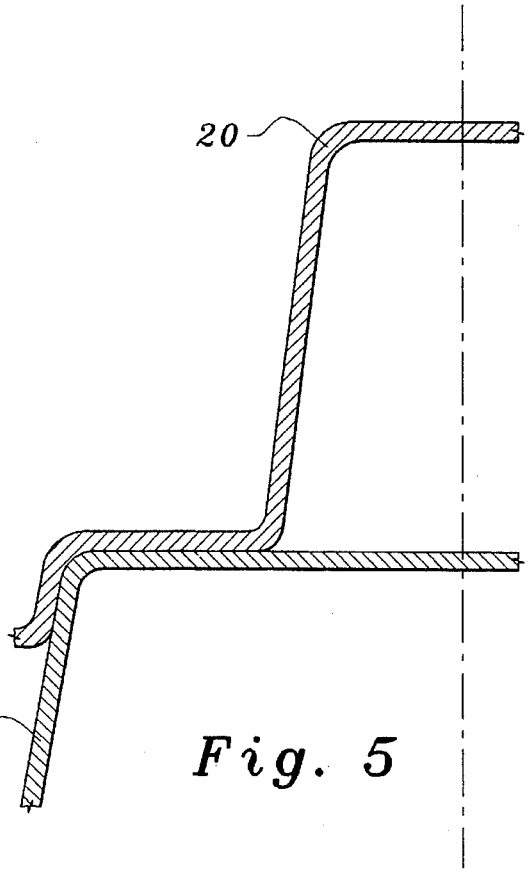
FIG. 5 is a detail of a vertical cross-section showing the junction of the lower and upper sections.

The central portion of the upper platform 30 extends axially upward to form a hand grip by which the assembly can be rotated; see FIG. 1 and the detail in FIG. 5. This grip is shown as a truncated cone, but may be cylindrical, spherical, or some other shape suitable for gripping.

It is understood that more platforms may be added to the structure. Additional sections of the central shaft, each supporting a platform, can be stacked on the structure and adhesively secured. The hand grip, described above, is formed by the upper portion of the top platform.

The embodiments shown and described above are only exemplary. I do not claim to have invented all the parts, elements, or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

SUBJECT MATTER CLAIMED FOR PROTECTION

I claim as my invention:

1. A device to display fingernail colors and styles of artificial fingernails, comprising:

a) a base, b) a central shaft rotatably mounted on said base, c) at least one platform attached to and extending from said shaft, d) said platform having means for holding artificial fingernail blanks around a perimeter thereof, said means including a perimeter of said platform having a series of apertures therein, with an open end of said apertures fading outward around a perimeter of said platform, e) a grip by which said platform is rotated, f) said apertures for receiving artificial fingernail blanks in the open end of said apertures so that said blanks inserted into said apertures are retained therein by friction.

2. The invention as described in claim 1, wherein:

g) said platform includes an upper disc-shaped portion attached to a lower disc-shaped portion of equal diameter, h) said upper portion having a fluted perimeter and said lower portion having a planar perimeter so that when attached a series of apertures are formed in a perimeter of said platform, said apertures for receiving artificial fingernail blanks, i) a surface on said upper portion above each fingernail aperture for writing the name of the fingernail color displayed in said aperture.

3. The invention as described in claim 2, wherein:

j) a central portion of said platform is extended axially to form a central shaft on which another platform is mounted so that two or more platforms are arranged in concentric tiers, and k) a central portion of an uppermost platform is extended axially upward to form a grip for rotating a platform assembly.

* * * * *